US010723119B2

(12) United States Patent
Hoshino et al.

(10) Patent No.: US 10,723,119 B2
(45) Date of Patent: Jul. 28, 2020

(54) DRYER, PRINTER, AND TREATMENT LIQUID APPLICATOR

(71) Applicants: Yoshiaki Hoshino, Kanagawa (JP); Ken Onodera, Kanagawa (JP); Toshihiro Yoshinuma, Kanagawa (JP)

(72) Inventors: Yoshiaki Hoshino, Kanagawa (JP); Ken Onodera, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 219 days.

(21) Appl. No.: 15/913,830

(22) Filed: Mar. 6, 2018

(65) Prior Publication Data

US 2018/0264803 A1 Sep. 20, 2018

(30) Foreign Application Priority Data

Mar. 17, 2017 (JP) ..... 2017-052046
Dec. 22, 2017 (JP) ..... 2017-246666

(51) Int. Cl.

| | |
|---|---|
| ***B41F 23/04*** | (2006.01) |
| ***B41J 11/00*** | (2006.01) |
| ***B41J 15/08*** | (2006.01) |
| *B41M 7/00* | (2006.01) |
| *B41M 5/00* | (2006.01) |

(52) U.S. Cl.

CPC ..... *B41F 23/0436* (2013.01); *B41F 23/0413* (2013.01); *B41F 23/0426* (2013.01); *B41F 23/0456* (2013.01); *B41F 23/0459* (2013.01); *B41F 23/0466* (2013.01); *B41J 11/002* (2013.01); *B41J 15/08* (2013.01); *B41M 5/0011* (2013.01); *B41M 7/009* (2013.01)

(58) Field of Classification Search

CPC ..... B41F 23/0436; B41F 23/0466; B41F 23/0456; B41F 23/0426; B41F 23/0413; B41F 23/0459; B41J 11/002; B41J 15/08; B41M 7/009; F26B 3/20; F26B 13/08; F26B 13/103; F26B 13/14; F26B 13/145; F26B 13/18; F26B 21/10

USPC ..... 34/68, 549, 446, 493, 496

See application file for complete search history.

(56) References Cited

U.S. PATENT DOCUMENTS 2,217,153 A * 10/1940 Bowdoin ..... F26B 11/181 34/527
3,073,038 A * 1/1963 Dapses ..... D21F 5/02 34/110

(Continued)

FOREIGN PATENT DOCUMENTS

| | | |
|---|---|---|
| JP | 2-182461 | 7/1990 |
| JP | 5-008372 | 1/1993 |

(Continued)

*Primary Examiner* — Edelmira Bosques
*Assistant Examiner* — Bao D Nguyen
(74) *Attorney, Agent, or Firm* — Duft & Bornsen, PC

(57) ABSTRACT

A dryer for drying a drying object includes a hot air generator to generate hot air to be blown onto the drying object, a contact heater to contact and heat the drying object, and a controller to control a heating temperature of the contact heater and a temperature of the hot air. The controller controls the heating temperature of the contact heater to be above a first predetermined temperature from a start of generation of the hot air by the hot air generator until the temperature of the hot air reaches a second predetermined temperature.

11 Claims, 13 Drawing Sheets

(56) References Cited

U.S. PATENT DOCUMENTS 3,296,014 A * 1/1967 Williams ..... D21H 5/0067 427/362
3,518,152 A * 6/1970 Storti ..... B32B 5/26 156/540
4,501,072 A * 2/1985 Jacobi, Jr. ..... F26B 3/283 101/488
5,138,379 A * 8/1992 Kanazashi ..... G03G 15/2064 399/331
5,233,763 A * 8/1993 Minnie, Jr. ..... F26B 3/283 110/223
5,261,166 A * 11/1993 Seeley ..... F26B 3/283 34/267
5,452,524 A * 9/1995 Isozaki ..... G03D 15/022 34/114
5,496,406 A * 3/1996 Beisswanger ..... B65H 20/14 118/643
5,589,321 A * 12/1996 Matsuda ..... G03C 1/74 34/420
5,675,913 A * 10/1997 Matsuda ..... F26B 13/145 34/526
5,787,321 A * 7/1998 Nishikawa ..... G03G 15/2042 165/205
5,980,126 A * 11/1999 Yamamoto ..... G03D 13/007 396/571
6,427,594 B1 * 8/2002 Secor ..... F26B 3/283 101/424.1
7,277,650 B2 * 10/2007 Ihara ..... G03G 15/2039 399/67
7,551,869 B2 * 6/2009 Kishi ..... G03G 15/205 399/69
9,994,049 B1 * 6/2018 Boland ..... B65H 20/02
2005/0025889 A1 * 2/2005 Yago ..... B05D 3/0413 427/314
2005/0238379 A1 * 10/2005 Ogane ..... G03G 15/0258 399/92
2006/0251440 A1 * 11/2006 Tatematsu ..... G03G 15/205 399/69
2007/0047991 A1 * 3/2007 Itoh ..... G03G 15/2064 399/69
2008/0267651 A1 * 10/2008 Gruszczynski .... G03G 15/2039 399/69
2011/0014408 A1 * 1/2011 Fujiwara ..... B29O 43/222 428/36.92
2011/0131829 A1 * 6/2011 Zagar ..... F26B 13/104 34/274
2012/0210894 A1 * 8/2012 Nagase ..... B41O 1/05 101/395
2012/0212551 A1 * 8/2012 Furukawa ..... B41J 2/01 347/101
2012/0212552 A1 * 8/2012 Houjou ..... B41J 2/01 347/101
2013/0108298 A1 * 5/2013 Chiyoda ..... G03G 15/2028 399/69
2013/0162714 A1 * 6/2013 Kobayashi ..... B41M 5/00 347/17
2014/0210919 A1 * 7/2014 Walker ..... B41J 11/002 347/102
2014/0232797 A1 * 8/2014 Onodera ..... B41F 23/042 347/102
2015/0174921 A1 6/2015 Onodera et al.
2015/0338794 A1 * 11/2015 Kitagawa ..... G03G 15/2017 399/70
2016/0101635 A1 * 4/2016 Hoshino ..... B41J 11/002 347/102
2016/0263914 A1 * 9/2016 Hoshino ..... B41J 11/002
2016/0273832 A1 * 9/2016 Asada ..... F26B 13/08
2016/0303874 A1 * 10/2016 Ferrara, Jr. ..... B41J 11/0015
2017/0120625 A1 * 5/2017 Yoshinuma ..... B41J 11/002
2017/0157951 A1 * 6/2017 Onodera ..... B41M 5/0017
2017/0173974 A1 6/2017 Hoshino et al.
2017/0266990 A1 * 9/2017 Yoshinuma ..... B41J 11/0045
2017/0266991 A1 * 9/2017 Onodera ..... B41J 11/002
2017/0334217 A1 * 11/2017 Yoshinuma ..... B41J 11/0015
2018/0009237 A1 * 1/2018 Sakamoto ..... B41J 11/002
2018/0022114 A1 * 1/2018 Sakamoto ..... B41J 11/002 347/16
2018/0081306 A1 * 3/2018 Haseba ..... G03G 15/2017
2018/0222178 A1 * 8/2018 Boland ..... B41F 23/0413
2018/0264849 A1 * 9/2018 Kitaoka ..... B41J 11/002
2018/0266763 A1 * 9/2018 Yoshinuma ..... F26B 3/20

FOREIGN PATENT DOCUMENTS

JP 2002-347226 12/2002
JP 2011-230494 11/2011
JP 2014-148168 8/2014
JP 2016-030015 3/2016

* cited by examiner

| ROLLER DIAMETER (mm) | COCKLING HEIGHT (mm) | COCKLING PITCH (mm) | VISUAL INSPECTION |
|---|---|---|---|
| 250 | 0.11 | 5 | COCKLING |
| 200 | 0.06 | 4 | COCKLING |
| 150 | 0.06 | 4.5 | COCKLING |
| 100 | 0.02 | NO PITCH | NO COCKLING |

| TEMPERATURE DETECTED BY TEMPERATURE SENSOR 45 | HEATING TEMPERATURE OF HEATING ROLLER 11 |
|---|---|
| BELOW 60°C | 160°C |
| 60°C OR ABOVE AND BELOW 80°C | 140°C |
| 80°C OR ABOVE AND BELOW 100°C | 120°C |
| 100°C OR ABOVE | 100°C |

DRYER, PRINTER, AND TREATMENT LIQUID APPLICATOR

CROSS-REFERENCE TO RELATED APPLICATIONS

This patent application is based on and claims priority pursuant to 35 U.S.C. § 119(a) to Japanese Patent Application No. 2017-052046, filed on Mar. 17, 2017 in the Japan Patent Office and Japanese Patent Application No. 2017-246666, filed on Dec. 22, 2017 in the Japan Patent Office, the entire disclosures of which are hereby incorporated by reference herein.

BACKGROUND

Technical Field

Aspects of the present disclosure generally relate to a dryer, a printer, and a treatment liquid applicator.

Related Art

An apparatus is known that applies liquid to a continuous sheet or the like conveyed as a recording medium and then dries the continuous sheet with a dryer.

The dryer includes a fixing device and a preheating device. The fixing device includes a blower to blow hot air onto the conveyed recording medium and a return mechanism for returning the hot air blown onto the recording medium to the blower. In addition, a preheating device heats the recording medium upstream from an area where the hot air is blown onto the recording medium from the fixing device in the conveyance direction of the recording medium.

Further, a dew point temperature is calculated by detecting a temperature of the hot air, and the preheating device is turned on and off based on the dew point temperature and the temperature of the preheating device.

SUMMARY

In an aspect of this disclosure, a novel dryer for drying a drying object includes a hot air generator to generate hot air to be blown onto the drying object, a contact heater to contact and heat the drying object, and a controller to control a heating temperature of the contact heater and a temperature of the hot air. The controller controls the heating temperature of the contact heater to be above a first predetermined temperature from a start of generation of the hot air by the hot air generator until the temperature of the hot air reaches a second predetermined temperature.

In another aspect of this disclosure, a printer includes a liquid applicator to apply liquid to a drying object, and the dryer as described above.

In still another aspect of this disclosure, a treatment liquid applicator includes a liquid applicator to apply treatment liquid to a drying object, and the dryer as described above.

In still another aspect of this disclosure, a dryer for drying a drying object includes a hot air generator to generate hot air to be blown onto the drying object, a contact heater to contact and heat the drying object, and a controller to control a heating temperature of the contact heater and a temperature of the hot air. The controller controls the heating temperature of the contact heater to be above a first predetermined temperature from a start of generation of the hot air by the hot air generator until a predetermined time elapses.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
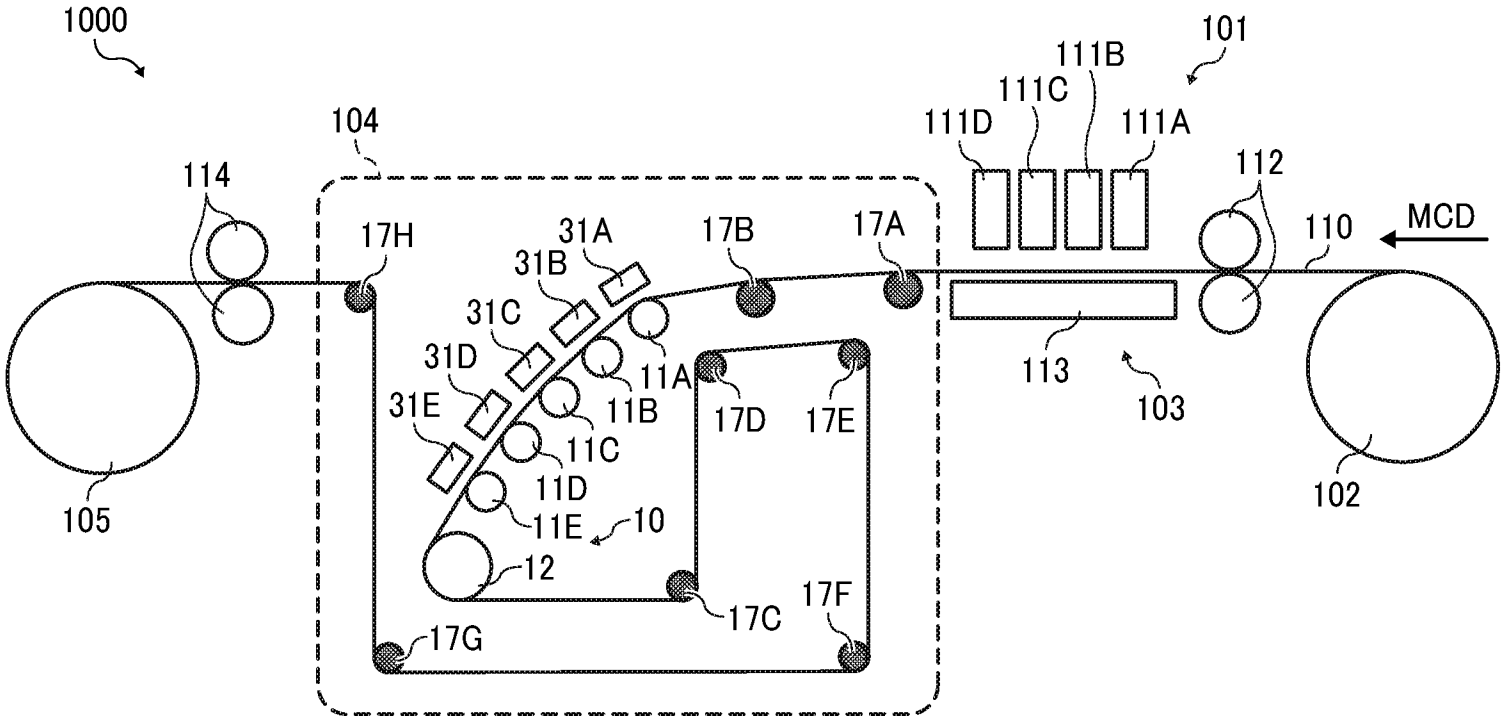
FIG. 1 is a schematic front view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

A printer 1000 according to a first embodiment of the present disclosure is described with reference to FIG. 1.

FIG. 1 is a schematic front view of the printer 1000. The printer 1000 is an inkjet recording apparatus, and includes a liquid application unit 101 including a plurality of liquid discharge heads 111A-111D, which is a liquid applicator, to discharge and apply ink onto a continuous sheet 110. The ink is liquid of one or more desired colors, applied to a continuous sheet 110. The continuous sheet 110 is conveyed and dried. Hereinafter, "the liquid discharge head" is simply referred to as the "the head".

The liquid application unit 101 includes, for example, full-line heads 111A, 111B, 111C, and 111D of four colors (collectively referred to as "heads 111" unless colors are to be distinguished) disposed in this order from the upstream side in a medium conveyance direction (MCD) of the continuous sheet 110. The heads 111 apply liquids of black (K), cyan (C), magenta (M), and yellow (Y) to the continuous sheet 110. Note that the number and types of color are not limited to the above-described four colors of K, C, M, and Y and may be any other suitable number and types.

The continuous sheet 110 fed from a feeding roller 102 is sent to a conveyance guide 113, which is disposed to face the liquid application unit 101, by conveyance rollers 112 of a conveyance unit 103 and is conveyed by being guided by the conveyance guide 113.

The continuous sheet 110 onto which the liquid is applied by the liquid application unit 101 is pulled by ejection rollers 114 through a dryer 104 according to the present embodiment, and is wound around a winding roller 105.

Next, the dryer according to the first embodiment is described with reference to FIGS. 2 and 3.

Figure 2:
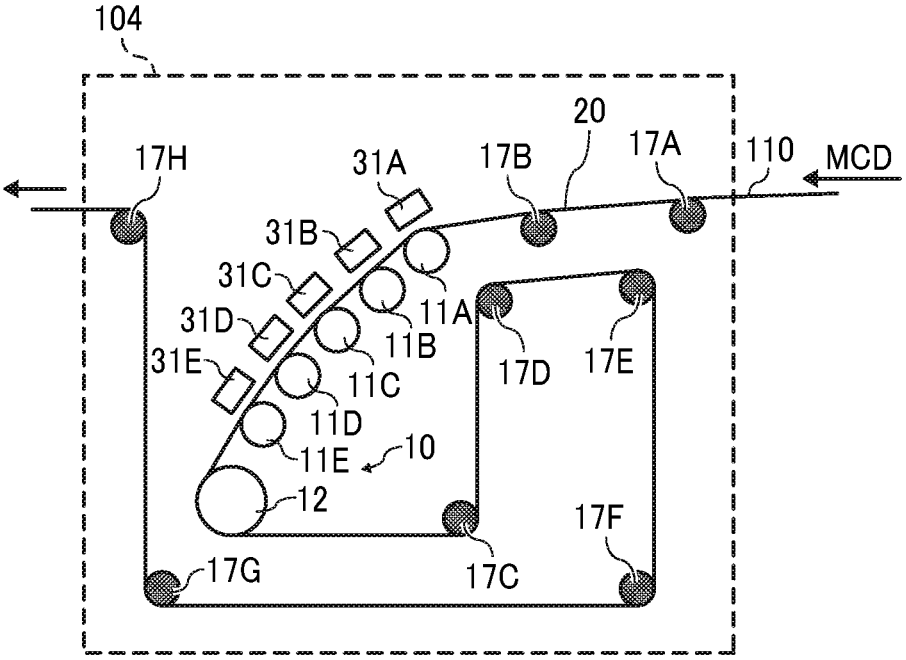
FIG. 2 is an enlarged front view of a dryer in the first embodiment.
Figure 3A:
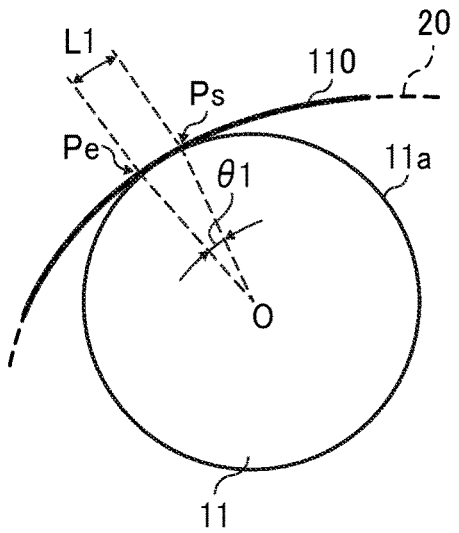
FIGS. 3A and 3B are front views of a heating roller and a heating drum for explaining a winding angle of a continuous sheet to the heating roller and the heating drum.
Figure 3B:
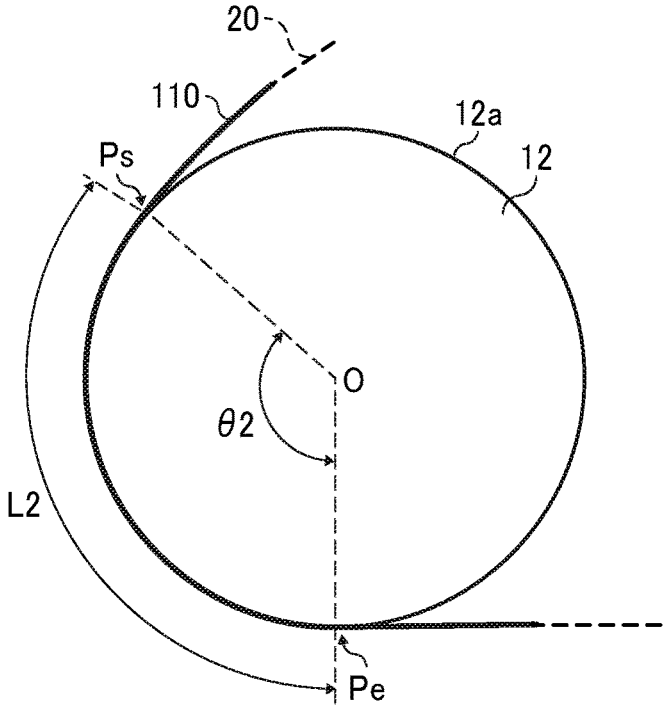

FIG. 2 is an enlarged cross-sectional view of the dryer 104. FIGS. 3A and 3B are illustrations of a winding angle with respect to a heating roller and a heating drum.

The dryer 104 includes the contact heater 10 to heat the continuous sheet 110 in contact with a surface of the continuous sheet 110 on a side opposite a surface onto which the liquid is applied. Thus, the contact heater 10 contacts and heats the continuous sheet 110.

The dryer 104 further includes non-contact heaters 31A to 31E for supplying hot air and radiant heat to the surface of the continuous sheet 110, to which the liquid is applied, in a noncontact manner.

The dryer 104 includes guide rollers 17A and 17B to guide the continuous sheet 110 to a contact heater 10, and guide rollers 17C to 17H to guide the continuous sheet 110 that passes through the contact heater 10.

The contact heater 10 includes a plurality of heating rollers 11A to 11E, which serves as first heater, each including a curved contact face 11*a* to contact the continuous sheet 110, and a heating drum 12, which serves as a second heater, including a curved contact face 12*a* to also contact the continuous sheet 110. Although in the present embodiment the heating rollers 11A to 11E have identical diameters, alternatively the heating rollers 11A to 11E may have different diameters. Further, in the present embodiment, all of the heating rollers 11A to 11E and the heating drum 12 are rollers.

Here, the plurality of heating rollers 11A to 11E (hereinafter, also collectively referred to as "heating rollers 11" unless otherwise distinguished; other members are also the same) and the heating drum 12 are disposed side by side in an arcuate (or circular arc) arrangement along the conveyance direction of the continuous sheet 110 indicated by arrow MCD (medium conveyance direction) in FIG. 2.

As illustrated in FIGS. 3A and 3B, a conveyance path 20 is configured such that a contact distance L2 between a contact face 12*a* of the heating drum 12 and the continuous sheet 110 is longer than a contact distance L1 between a contact face 11*a* of each of the heating rollers 11A to 11E and the continuous sheet 110. Note that the conveyance path 20 of the continuous sheet 110 is defined by the plurality of heating rollers 11A to 11E, the heating drum 12, and the plurality of guide rollers 17A to 17H.

The "contact distance" is a distance over which the continuous sheet 110 contacts a circumferential surface of the heating drum 12 and the heating roller 11 in a direction along a circumferential direction of the heating drum 12 and the heating roller 11 (the medium feeding direction).

When the dryer 104 is a curved surface heater including a curved member having a curved surface as a contact face, the contact distance is a distance over which the continuous sheet 110 is in contact with the curved surface in the direction (medium feeding direction) along the circumferential direction of the curved surface.

Here, a winding angle θ2 of the continuous sheet 110 with respect to the contact face 12*a* of the heating drum 12 is greater than a winding angle θ1 of the continuous sheet 110 with respect to the contact face 11*a* of the heating roller 11 (θ2>θ1).

As illustrated in FIGS. 3A and 3B, the winding angles θ2 and θ1 (collectively referred to as "winding angle θ") indicate angles of a point Ps at which the contact of the continuous sheet 110 with the contact faces 12*a* and 11*a* starts and a point Pe at which the contact of the continuous sheet 110 with the contact faces 12*a* and 11*a* ends, with respect to a center O.

Therefore, in a case where the winding angle θ increases, the contact distance also increases insofar as rotary bodies have the same diameter, and even in a case where the winding angles θ are identical to each other, the contact distance increases as the diameter of the rotary body increases.

In the present embodiment, the diameter of the heating drum 12 is greater than the diameter of the heating roller 11, and the winding angle θ2 is greater than the winding angle θ1.

Thus, in any case, the contact distance L2 between the contact face 12*a* of the heating drum 12 and the continuous sheet 110 is longer than the contact distance L1 between the contact face 11*a* of the heating roller 11 and the continuous sheet 110.

As described above, even if the winding angles θ are identical to each other, the contact distance increases as the diameter of the rotary body increases.

Therefore, by setting the heating drum 12 and the heating roller 11 to have the same diameter and by setting the winding angle θ2 to be greater than the winding angle θ1, the contact distance L2 between the contact face 12*a* of the heating drum 12 and the continuous sheet 110 becomes longer than the contact distance L1 between the contact face 11*a* of the heating roller 11 and the continuous sheet 110.

As described above, the conveyance path 20 is configured so that the contact distance L2 between the contact face 12*a* of the heating drum 12 and the continuous sheet 110 is longer than the contact distance L1 between each of the contact face 11*a* of the heating rollers 11 and the continuous sheet 110.

Such a configuration can reduce cockling of the continuous sheet 110 and increase the drying efficiency of the dryer 104.

For example, in a state in which time does not elapse from the liquid application, the strength of the continuous sheet 110 decreases. Accordingly, it may be difficult to bring a rear surface the continuous sheet 110 closely into contact with a circumferential surface (a contact face) of the rotary body in a wide range (a long contact distance).

Hence, in an initial state where the applied liquid is not dried, the winding angle θ of the continuous sheet 110 with respect to the heating roller 11 is set to be small, and thus, the contact distance is shortened.

Here, by increasing the curvature of the heating roller 11, a tensile force generated at the time of conveying the continuous sheet 110 is changed to a pressing force on a contact portion of the continuous sheet 110 with the heating roller 11. Thus, a contact state of the continuous sheet 110 with the heating roller 11 becomes even.

In such a state, cockling or wrinkles do not occur in the continuous sheet 110, and when the continuous sheet 110 passes through the heating roller 11, a heat required for evenly drying the liquid on the continuous sheet 110 can be supplied.

Accordingly, the continuous sheet 110, in which the cockling is reduced and the drying is performed, can closely contact the contact face of the rotary body even when the contact distance of the continuous sheet 110 with the rotary body increases.

Next, an example of a relation between the roller diameter of the heating roller 11 and the cockling of the continuous sheet 110 is described with reference to FIG. 4.

Figures 4, 5:
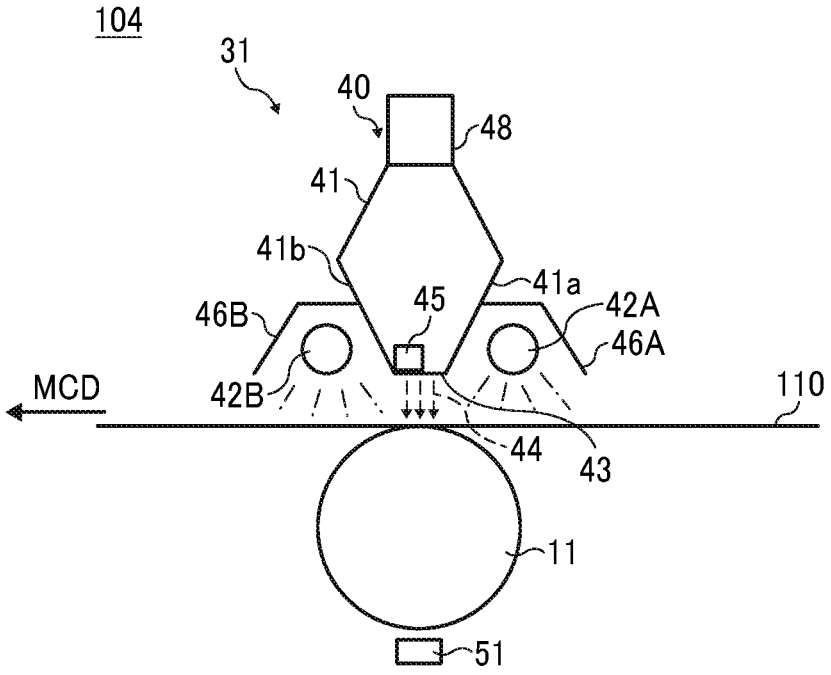
FIG. 4 is a table illustrating a relation between diameters of the heating rollers and cockling of the recording medium.
FIG. 5 is a front view of a non-contact heater.

FIG. 4 is a table of results of measuring a height of cockling and a pitch of cockling occurring in the continuous sheet 110 while changing the diameter of the heating roller 11. FIG. 4 further illustrates a presence or an absence of visually observable cockling checked while changing the diameter of the heating roller 11.

From this result, in this example, it is known that the cockling height is almost halved by setting the diameter of the heating roller 11 to 200 mm compared with a case where the diameter of the heating roller 11 is 250 mm.

Further, the cockling disappears by setting the diameter of the heating roller 11 to be 100 mm or less.

Therefore, the diameter of the heating roller 11 is preferably 200 mm or less, more preferably 100 mm or less.

Therefore, the present embodiment can supply heat to the continuous sheet 110 in a short time by increasing the contact distance L2 between the continuous sheet 110 and the heating drum 12 disposed downstream from the heating roller 11.

Thus, the present embodiment can improve the drying efficiency and dry the continuous sheet 110 in a short time.

It is possible to increase a drying speed even for a thick continuous sheet 110 and ensure high productivity by increasing the number of heating rollers 11 contacting the continuous sheet 110 to increase a heat quantity for drying the continuous sheet 110.

Next, the non-contact heaters 31A to 31E are described with reference to FIGS. 5 and 6.

FIG. 5 is a front view of any one of the non-contact heaters 31A to 31E. FIG. 6 is a perspective view of the non-contact heaters 31A to 31E.

The non-contact heaters 31A to 31E include a hot air generator 40 and an infrared heater collectively designated 42 (42A and 42B). The infrared heater 42 is a radiation heater serving as a part of the hot air generator 40.

The hot air generator 40 includes a chamber 41, a blowing fan 48 (blower), and an infrared heater 42. The chamber 41 includes a blowing part (nozzle 43) for blowing hot air 44 toward the continuous sheet 110. The blowing fan 48 sends air to the chamber 41. The infrared heater 42 is a radiant heater for heating the air in the chamber 41 by radiant heat.

The hot air is blown from the nozzle 43 of the chamber 41 to the continuous sheet 110 at a region including the contact position between the heating roller 11 and the continuous sheet 110.

Blowing the hot air to the contact position between the heating roller 11 and the continuous sheet 110 can blow off air containing vaporized moisture.

Thus, the present embodiment can prevent the evaporated moisture from reattaching to the continuous sheet 110 and causing a reduction in drying efficiency.

The infrared heaters 42A and 42B are disposed on the upstream side and the downstream side of the chamber 41, respectively.

The chamber 41 includes reflecting plates 46A and 46B are attached to the back side of the infrared heaters 42A and 42B (the side opposite to the continuous sheet 110). The chamber 41 includes side walls 41*a* and 41*b* to be heated by the infrared heaters 42A and 42B.

The chamber 41 includes a temperature sensor 45 serving as a temperature detector for detecting a temperature of the hot air 44 to be blown onto the continuous sheet 110.

Further, a temperature sensor 51 is provided to detect a temperature of the heating roller 11.

With this configuration, the non-contact heaters 31A to 31E send the air to the chamber 41 by turning on the blowing fan 48 of the hot air generator 40 to blow the hot air in the chamber 41 from the nozzle 43 onto the continuous sheet 110.

At this time, the infrared heaters 42A and 42B in ON state heat the side walls 41*a* and 41*b* of the chamber 41 by the radiant heat of the infrared heaters 42A and 42B. Thus, air inside the chamber 41 is heated.

As a result, the hot air 44, which is heated by the infrared heaters 42A and 42B, is blown from the nozzle 43 toward the continuous sheet 110.

Further, the continuous sheet 110 is also heated by radiant heat directly supplied by the infrared heaters 42.

In the non-contact heaters 31A to 31E of the present embodiment, the infrared heaters 42A and 42B are disposed outside the chamber 41 at a position facing the continuous sheet 110 and close to side walls 41*a* and 41*b* of the chamber 41.

Thus, the present embodiment can irradiate the continuous sheet 110 with the radiant heat of the infrared heaters 42A and 42B. The infrared heaters 42A and 42B also heat the side walls 41*a* and 41*b* of the chamber 41 with the radiant heat to heat the air inside the chamber 41.

As a result, the present embodiment can efficiently perform a non-contact heating by the infrared heaters 42A and 42B. The infrared heaters 42A and 42B are commonly used for infrared heating and hot air heating of the continuous sheet 110.

Figure 7:
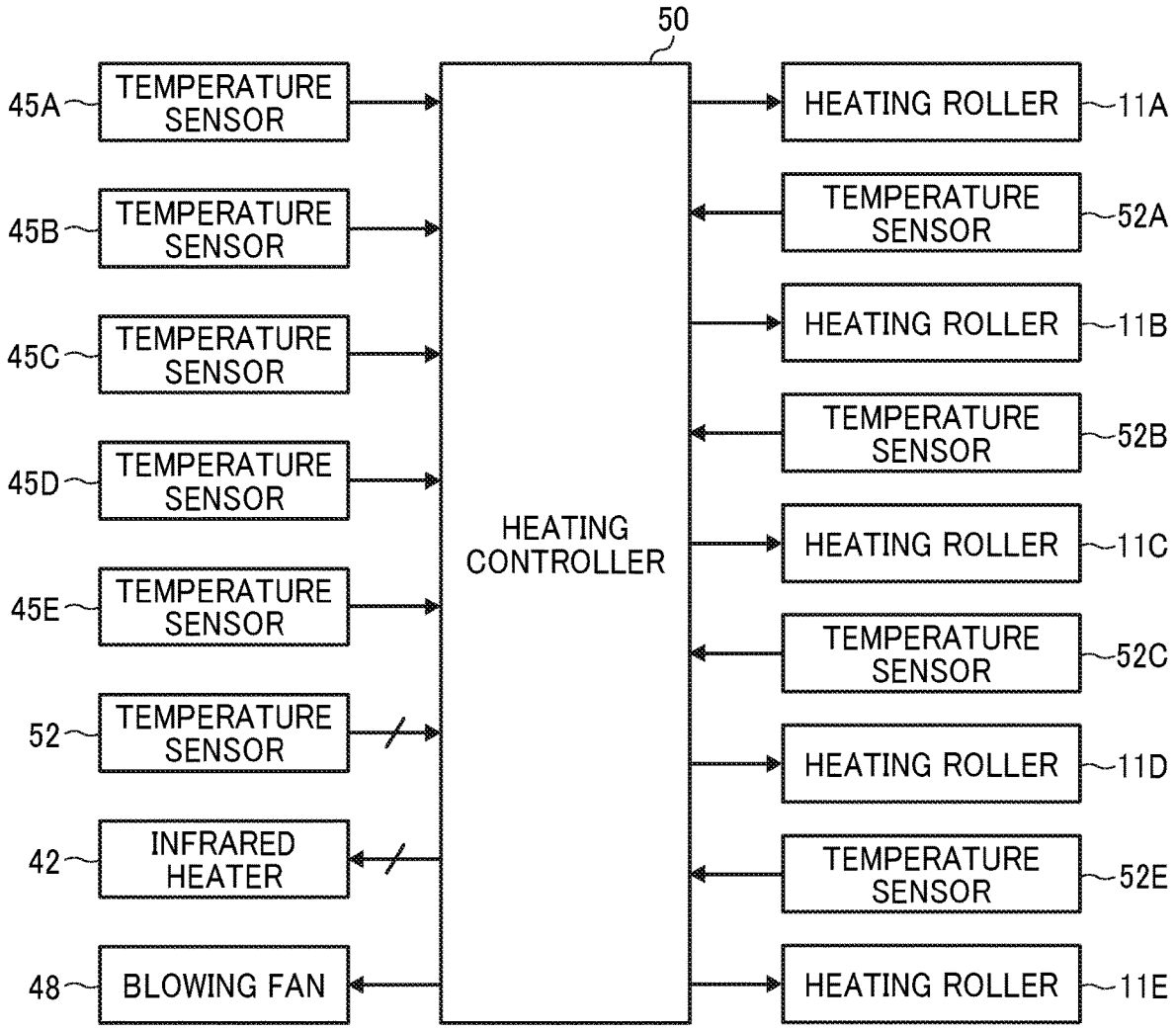
FIG. 7 is a block diagram of the dryer.

Next, a portion related to a temperature control of the heating roller 11 is described with reference to a block diagram of FIG. 7.

The controller 50 receives the detection signals of each temperature sensor 45 (45A to 45E) that detects the temperature of the hot air 44 to determine the temperature of the hot air 44.

The controller 50 adjusts the temperature of the heating roller 11 (11A to 11E) to a target temperature based on the temperature detected by the temperature sensor 51 serving as a temperature detector to detect the temperature of the heating rollers 11.

In addition, the controller 50 performs an ON/OFF control (including the air volume control) of the blowing fan 48 and a process of controlling the infrared heater 42 according to the detected temperature of the temperature sensor 52 (52A to 52E) serving as a temperature detector for detecting the temperature of the infrared heater 42.

Next, the control of the heating roller 11 by the controller is described with reference also to FIGS. 8 and 9.

Figures 8, 9:
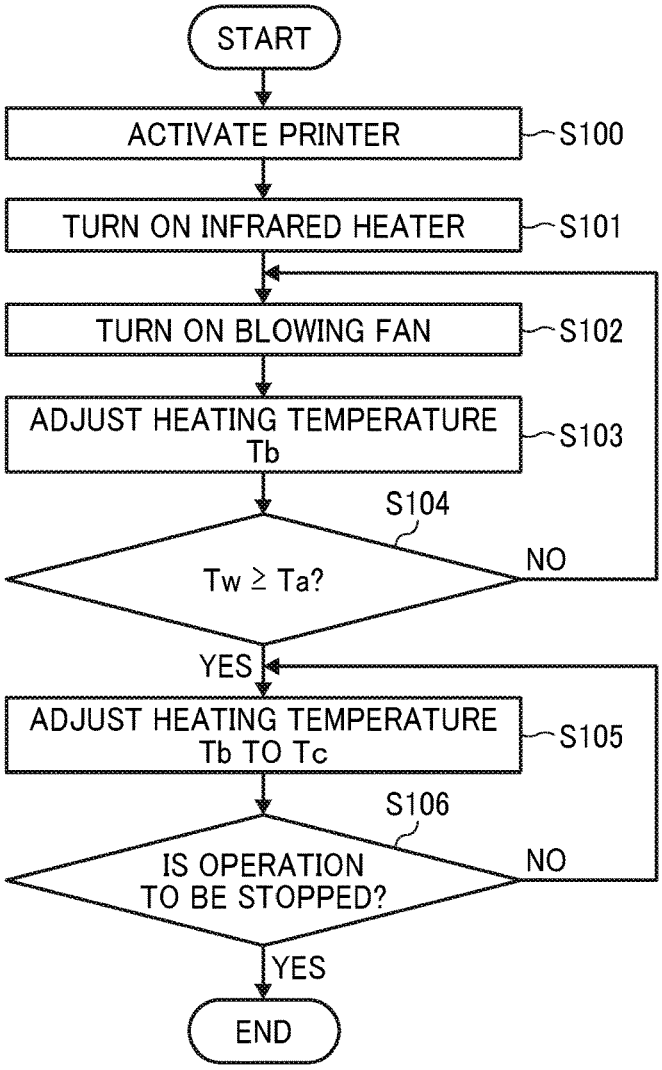
FIG. 8 is a flow chart of a process of controlling the controller.
FIG. 9 is a table illustrating an example of target temperatures of the control of the heating roller by the controller.

FIG. 8 is a flow chart of the control.

FIG. 9 is a table illustrated an example of the target temperature of the control.

When the printer 1000 including the dryer 104 is activated (S100), the controller 50 turns on the infrared heater 42 to start radiating the infrared rays (S101).

Then, the blowing fan 48 is turned on to start blowing the air to the chamber 41 (S102).

As a result, the hot air 44 is blown out from the nozzle 43 of the chamber 41. The temperature of the hot air 44 (heating temperature Tb) increases as the temperature inside the chamber 41 increases due to the radiant heat supplied from the infrared heaters 42A and 42B (S103). Thus, the heating temperature Tb is adjusted (increased) by controlling the infrared heaters 42A and 42B (S103).

Further, the heating roller 11 is also turned on to start heating.

The order of turning on the infrared heater 42, the blowing fan 48, and the heating roller 11 is not limited to the order as described above.

For example, the controller 50 may start blowing the hot air 44 by turning on the blowing fan 48 after turning on the heating roller 11.

Here, until a temperature Tw of the hot air 44 generated by the hot air generator 40 reaches a second predetermined temperature Ta (for example, 60° C.), the controller 50 keeps the heating temperature Tb of the heating roller 11 above a first predetermined temperature Tc (Tb>Tc) (S104, NO). The first predetermined temperature Tc is a temperature of the heating roller 11 after the temperature Tw of the hot air 44 becomes the second predetermined temperature Ta.

Here, the heating temperature Tb of the heating rollers 11 is, for example, the temperature of the surface of the heating roller 11 or the temperature of the heater inside the heating roller 11.

After the temperature Tw of the hot air 44 has reached the second predetermined temperature Ta (S104, YES), the controller 50 controls power supply to the heating roller 11 so that the heating temperature Tb of the heating rollers 11 becomes the first predetermined temperature Tc according to a temperature detected by the temperature sensor 45 (S105 and S106, NO). Thus, the heating temperature Tb is adjusted to become the first predetermined temperature Tc (S105). The controller 50 stops a control operation when the heating temperature Tb of the heating rollers 11 becomes the first predetermined temperature Tc (S106, YES).

A plurality of the first predetermined temperature Tc may be set according to the temperature Tw of the hot air 44.

For example, as illustrated in FIG. 9, the controller 50 adjusts the heating temperature Tb of the heating roller 11 to 160° C. (first predetermined temperature Tc) until the temperature Tw of the hot air 44 (the temperature detected by the temperature sensor 45) reaches 60° C. (second predetermined temperature Ta). That is, the controller 50 adjusts the heating temperature Tb of the heating roller 11 to 160° C. (first predetermined temperature Tc) while the temperature Tw of the hot air 44 is below 60° C. (second predetermined temperature Ta).

Then, as illustrated in FIG. 9, after the temperature Tw of the hot air 44 has reached 60° C., the controller 50 adjusts the heating temperature Tb to 140° C. when the temperature Tw of the hot air 44 is 60° C. or above and below 80° C. according to the temperature Tw of the hot air 44.

When the temperature Tw is 80° C. or above and below 100° C., the controller 50 adjusts the heating temperature Tb to 120° C. When the temperature Tw is 100° C. or above, the controller 50 adjusts the heating temperature Tb to 100° C.

The hot air 44 does not immediately reach the required temperature even if the infrared heater 42 is turned on because air in the chamber 41 does not immediately heat up. The infrared heater 42 constitutes the hot air generator 40.

Therefore, the controller 50 supplies a sufficient amount of heat to the continuous sheet 110 by increasing the heating temperature Tb of the heating roller 11 until the hot air 44 generated by the hot air generator 40 reaches the first predetermined temperature Tc.

Thus, the controller 50 can sufficiently dry the continuous sheet 110 immediately after starting generation of hot air, shorten startup time of the dryer 104, and shorten lead time until the start of conveyance of the continuous sheet 110 (drying object).

It should be noted that the controller 50 does not have to perform the above-described control of the controller 50 for all combinations of the plurality of non-contact heaters 31 and contact heaters 10. For example, the controller 50 may control only upstream side heating rollers 11A to 11C to increase the target temperature.

Next, the control of the heating rollers 11 by the controller 50 according to a second embodiment of the present disclosure is described with reference to FIG. 10.

Figure 10:
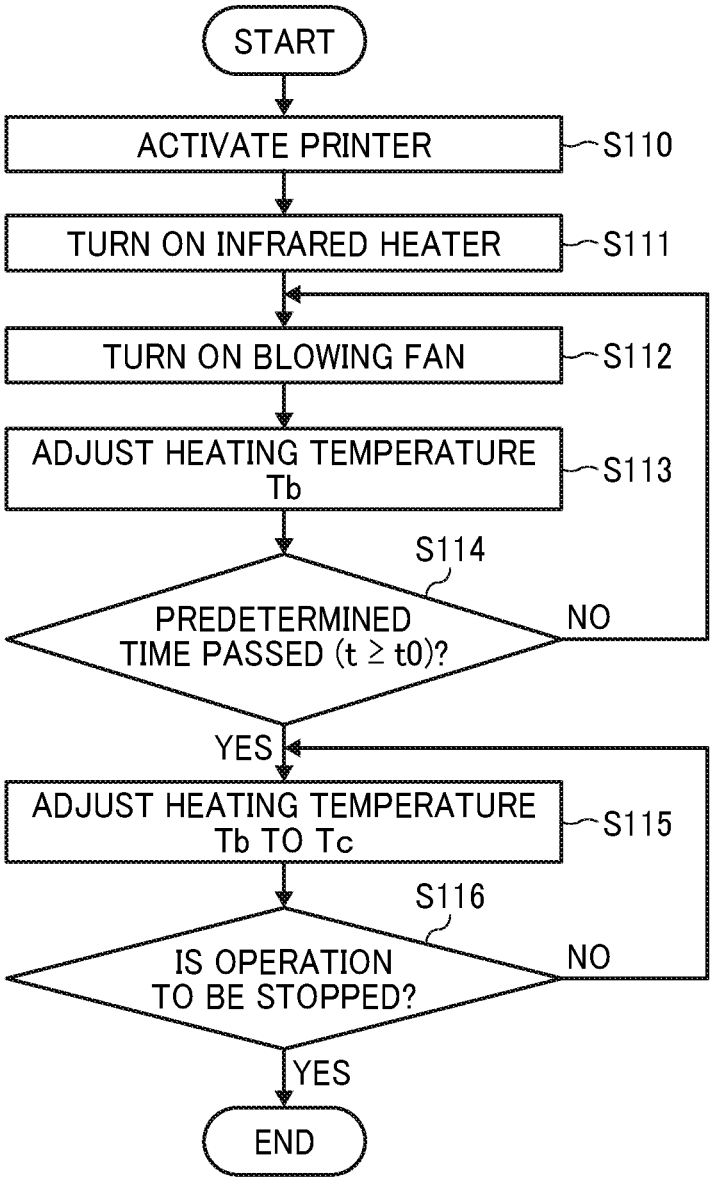
FIG. 10 is a flowchart of the control of the heating roller by a controller according to a second embodiment of the present disclosure.

FIG. 10 is a flow chart of the control of the controller 50.

In the second embodiment, the controller 50 adjusts the heating temperature Tb of the heating roller 11 to be higher than a first predetermined temperature Tc (Tb>Tc) until elapsed time t from a start of generation of the hot air 44 by the hot air generator 40 reaches the predetermined time t0 (t>t0). The first predetermined temperature Tc is a predetermined heating temperature of the heating roller 11. Thus, the controller 50 adjusts the heating temperature of the contact heater (heating roller 11) to be above a first predetermined temperature Tc from a start of generation of the hot air 44 by the hot air generator 40 until a predetermined time t0 elapses.

In this case, the controller 50 can determine that the temperature Tw of the hot air 44 has reached the second predetermined temperature Ta even if the temperature sensor 45 does not detect the temperature of the hot air 44. It is because the controller 50 can measure the time (predetermined time t0) until the temperature Tw of the hot air 44 reaches the second predetermined temperature Ta in advance.

Thus, the controller 50 can sufficiently dry the continuous sheet 110 immediately after starting generation of hot air, shorten startup time of the dryer 104, and shorten lead time until the start of conveyance of the continuous sheet 110 (drying object).

As an example of time when the hot air generator 40 starts generating the hot air 44, there are time when the dryer 104 is turned on, time when the printer 1000 including the dryer 104 is activated, time when the power supply to the infrared heater 42 is started, time when the conveyance of the continuous sheet 110 is started, and time when the printer 1000 receives a print job from outside, and the like.

As illustrated in FIG. 10, when the printer 1000 including the dryer 104 is activated (S110), the controller 50 turns on the infrared heater 42 to start radiating the infrared rays (S111). Then, the blowing fan 48 is turned on to start blowing the air to the chamber 41 (S112). As a result, the hot air 44 is blown out from the nozzle 43 of the chamber 41. The temperature of the hot air 44 (heating temperature Tb) increases as the temperature inside the chamber 41 increases due to the radiant heat supplied from the infrared heaters 42A and 42B (S113). Thus, the heating temperature Tb is adjusted (increased) by controlling the infrared heaters 42A and 42B (S113). Further, the heating roller 11 is also turned on to start heating.

The order of turning on the infrared heater 42, the blowing fan 48, and the heating roller 11 is not limited to the order as described above. For example, the controller 50 may start blowing the hot air 44 by turning on the blowing fan 48 after turning on the heating roller 11.

The controller 50 adjusts the heating temperature Tb of the heating roller 11 to be higher than a first predetermined temperature Tc (Tb>Tc) until elapsed time t from a start of generation of the hot air 44 by the hot air generator 40 reaches the predetermined time t0 (t>t0) (S114, NO).

After the elapsed time t from a start of generation of the hot air 44 by the hot air generator 40 reaches the predetermined time t0 (t>t0) (S114, YES), the controller 50 controls a power supply to the heating roller 11 so that the heating temperature Tb of the heating rollers 11 becomes the first predetermined temperature Tc according to a temperature detected by the temperature sensor 45 (S115 and S116, NO). Thus, the heating temperature Tb is adjusted to become the first predetermined temperature Tc (S115). The controller 50 stops a control operation when the heating temperature Tb of the heating rollers 11 becomes the first predetermined temperature Tc (S116, YES).

Non-contact heaters 31A to 31E of a dryer 104 according a third embodiment of the present disclosure are described in detail below with reference to FIG. 11.

Figure 11:
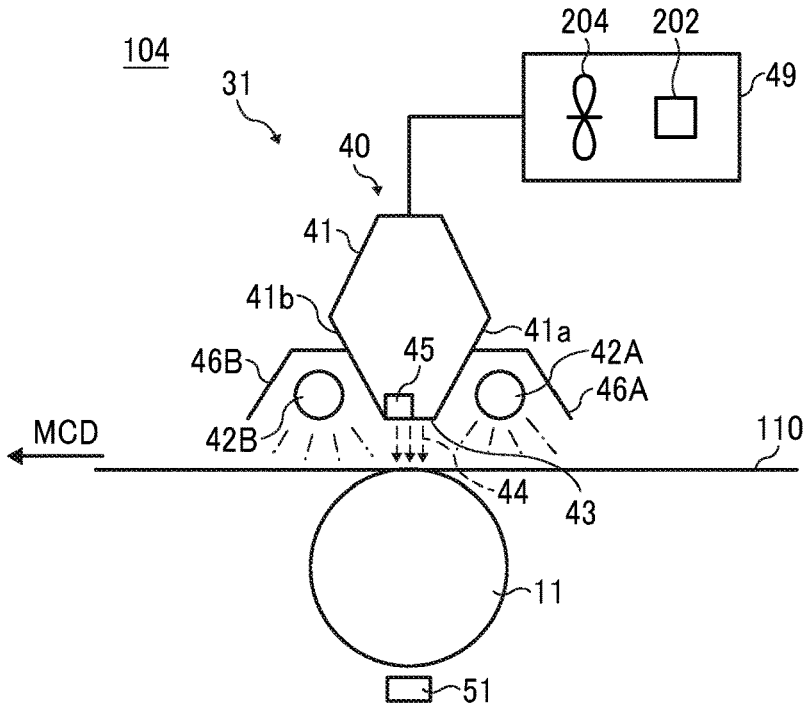
FIG. 11 is an enlarged cross sectional view of the non-contact heater of the dryer according to a third embodiment of the present disclosure.

FIG. 11 is a front view of the non-contact heaters 31A to 31E of the dryer 104. The non-contact heaters 31A to 31E according to the third embodiment include a hot air generating device 49 instead of the blowing fan 48 of the first embodiment. The hot air generating device 49 generates hot air.

The hot air generating device 49 sends hot air into the chamber 41. This hot air is further heated also by the infrared heater 42 in the chamber 41 and is blown out as the hot air 44 onto the continuous sheet 110.

The hot air generating device 49 includes a heater 202 as a heat generator and a blower 204. For example, the heater 202 may be a wire made of nickel, chrome, and iron alloy that generates heat when a voltage is applied to the wire by connecting the wire to a power supply.

Wind (air flow) generated by the blower 204 is heated by the heater 202. Further, the hot air heated by the heater 202 is further heated in the chamber 41, and the hot air 44 is blown out from the chamber 41.

Non-contact heaters 31A to 31E of a dryer 104 according a fourth embodiment of the present disclosure are described in detail below with reference to FIG. 12.

Figure 12:
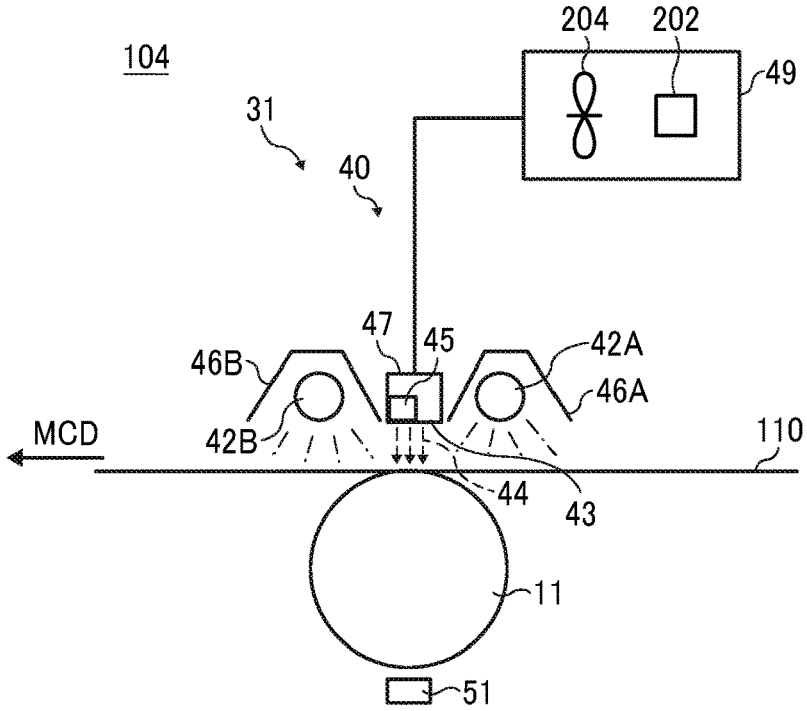
FIG. 12 is an enlarged cross sectional view of the non-contact heater of the dryer according to a fourth embodiment of the present disclosure.

FIG. 12 is a front view of the non-contact heaters 31A to 31E of the dryer 104.

The non-contact heaters 31A to 31E according to the fourth embodiment includes a hot air generating device 49 of the third embodiment instead of the blowing fan 48 of the first embodiment. The non-contact heaters 31A to 31E of the fourth embodiment include a blowout part 47 instead of the chamber 41. The non-contact heaters 31A to 31E blows the hot air generated by the hot air generating device 49 directly from the nozzle 43 of the blowout part as the hot air 44.

In this case, the fourth embodiment does positively heat the air inside the chamber 41 with the infrared heaters 42A and 42B.

With this configuration as well, the controller 50 adjusts the contact heater (heating roller 11) to a high heating temperature until the hot air generated by the hot air generating device 49 reaches the predetermined temperature since it takes a predetermined time for the heater 202 of the hot air generating device 49 to reach a predetermined temperature as in the above-described embodiment.

Non-contact heaters 31A to 31E of a dryer 104 according a fifth embodiment of the present disclosure are described in detail below with reference to FIG. 13.

Figure 13:
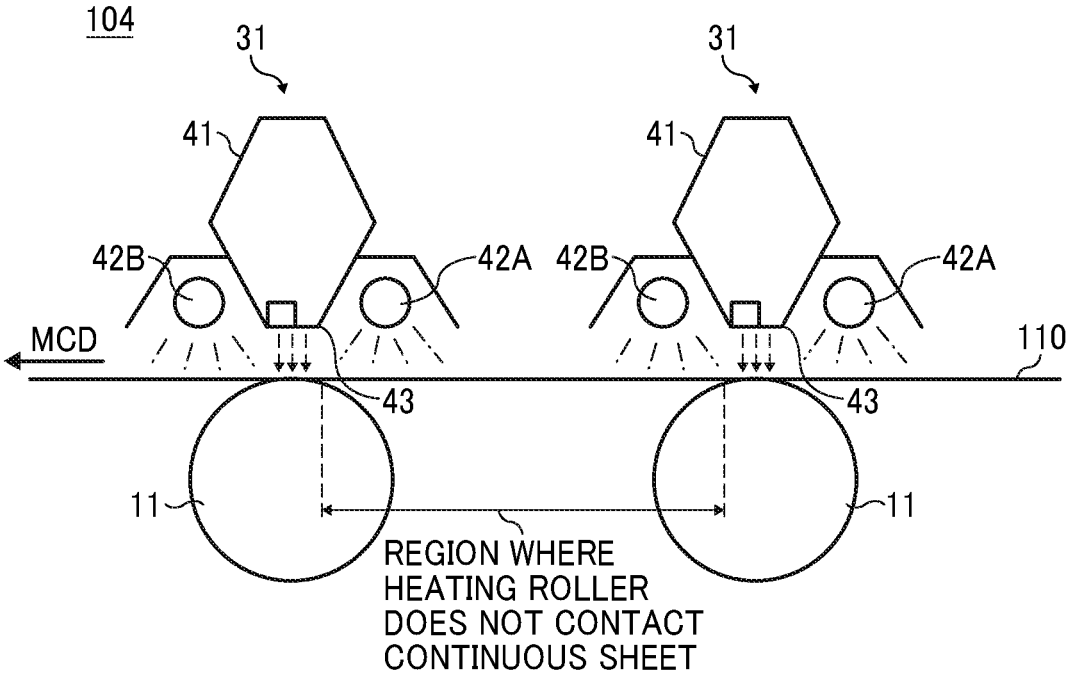
FIG. 13 is an enlarged cross sectional view of the non-contact heater of the dryer according to a fifth embodiment of the present disclosure.

FIG. 13 is an enlarged cross sectional view of the dryer 104.

The present embodiment includes a plurality of sets of a chamber 41 and a contact heater (heating roller 11). Each of the chambers 41 includes infrared heaters 42A and 42B and a nozzle 43 constituting the non-contact heaters 31A to 31E.

The infrared heaters 42A and 42B are disposed at a position facing the non-contact area where the continuous sheet 110 is not in contact with the heating roller 11 between the adjacent sets of the chamber 41 and the contact heater (heating roller 11).

The dryer 104 can irradiate the infrared rays from the two infrared heaters 42A and 42B at a portion between two heating rollers 11 where the heating rollers 11 do not contact the continuous sheet 110. Thus, it is possible to further efficiently dry the drying object (in this case, the continuous sheet 110).

Non-contact heaters 31A to 31E of a dryer 104 according a sixth embodiment of the present disclosure are described in detail below with reference to FIG. 14.

Figure 14:
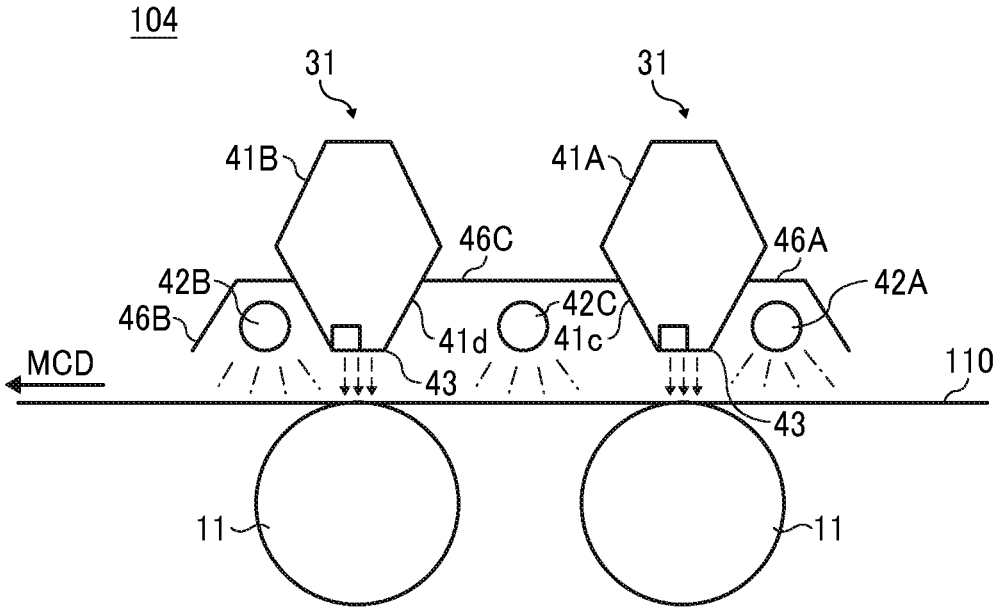
FIG. 14 is an enlarged cross sectional view of the non-contact heater of the dryer according to a sixth embodiment of the present disclosure.

FIG. 14 is an enlarged cross sectional view of the dryer 104.

In the present embodiment, adjacent non-contact heaters 31 are integrated as a single unit.

That is, a common infrared heater 42C is disposed between an upstream-side chamber 41A and a downstream-side chamber 41B. The common infrared heater 42C is surrounded by the side walls 41*c* and 41*d* of two chambers 41 (the upstream-side chamber 41A and the downstream-side chamber 41B) and a reflecting plate 46C.

As a result, the air in the two chambers 41 (the upstream-side chamber 41A and the downstream-side chamber 41B) can be heated by one number of the common infrared heater 42C. Thus, the dryer 104 of the sixth embodiment can further efficiently use infrared radiation radially irradiated from the common infrared heater 42C for generating hot air 44.

A dryer 104 according a seventh embodiment of the present disclosure is described in detail below with reference to FIG. 15.

Figure 15:
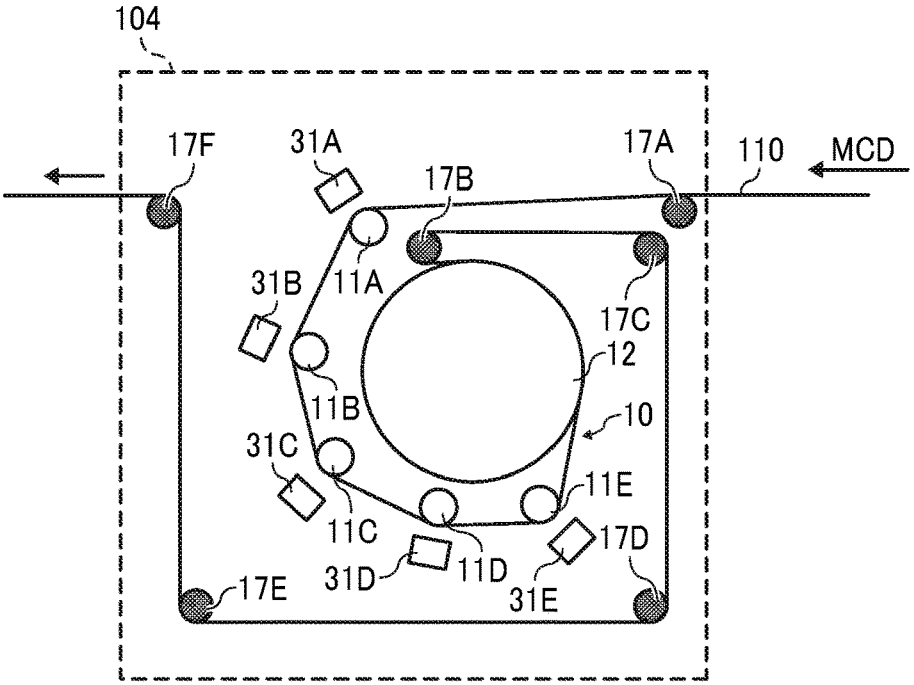
FIG. 15 is a schematic front view of the dryer according to a seventh embodiment of the present disclosure.

FIG. 15 is an enlarged cross sectional view of the dryer 104.

A plurality of heating rollers 11 (11A to 11E) are arranged around the heating drum 12.

The non-contact heaters 31 (31A to 31E) are disposed to face the heating rollers 11, respectively.

The dryer 104 according an eighth embodiment of the present disclosure is described in detail below with reference to FIG. 16.

Figure 16:
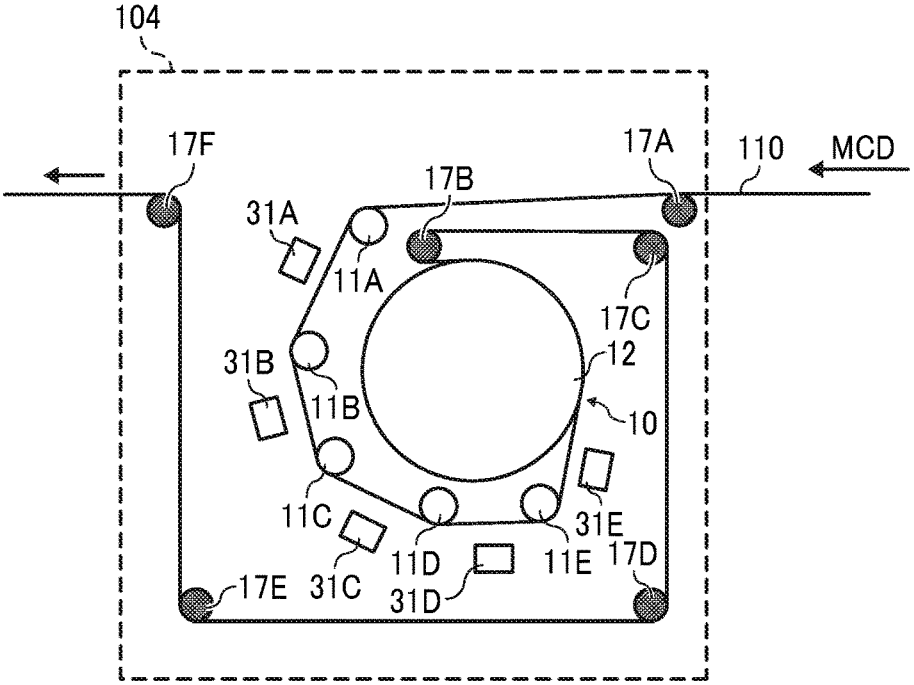
FIG. 16 is a schematic front view of the dryer according to an eighth embodiment of the present disclosure.

FIG. 16 is an enlarged cross sectional view of the dryer 104.

A plurality of heating rollers 11 (11A to 11E) are arranged around the heating drum 12.

Each of the non-contact heaters 31A to 31D is disposed between the corresponding one of the adjacent heating rollers 11A to 11E. The non-contact heater 31E is disposed between the heating roller 11E and the heating drum 12.

Here, the controller 50 performs temperature control by a combination of the non-contact heaters 31A to 31E and the heating rollers 11A to 11E.

A dryer 104 according a ninth embodiment of the present disclosure is described in detail below with reference to FIG. 17.

Figure 17:
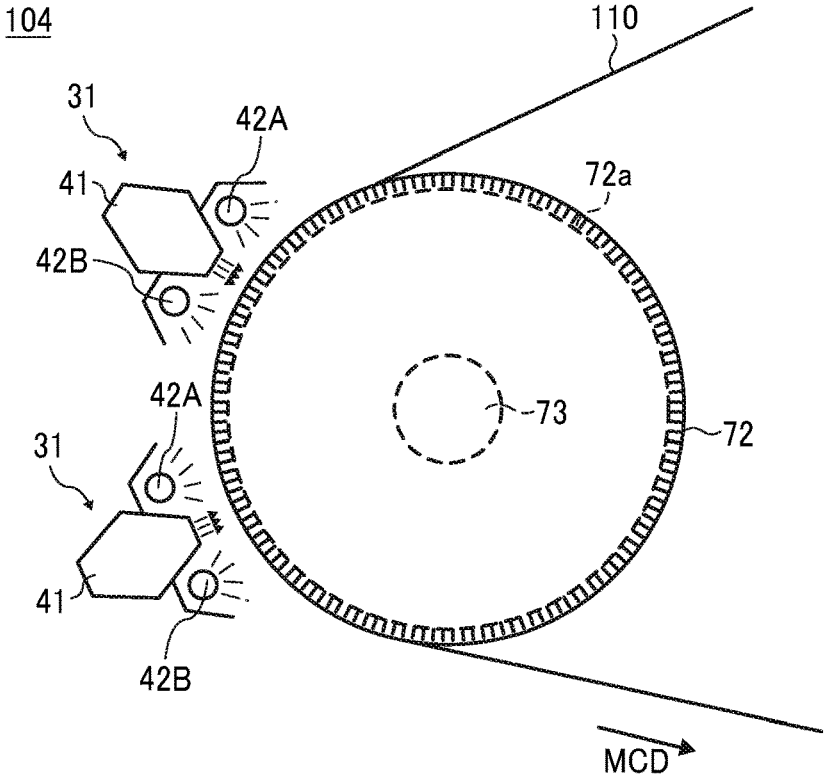
FIG. 17 is a schematic front view of the dryer according to a ninth embodiment of the present disclosure.

FIG. 17 is an enlarged cross sectional view of the dryer 104.

The dryer 104 according to the ninth embodiment includes a heating drum 72 serving as a contact heater. The heating drum 72 also serves as a transport drum for winding and transporting the continuous sheet 110 (drying object).

For example, the heating drum 72 includes a heat generator 73 such as a halogen heater inside the heating drum 72. The heating drum 72 vacuums air from suction holes 72*a* formed around a circumference of the heating drum 72 to attract and hold the continuous sheet 110 onto the peripheral surface of the heating drum 72. Then, the heating drum 72 rotates to transport the continuous sheet 110.

One or a plurality of non-contact heaters 31A to 31E is disposed to face the region where the continuous sheet 110 is in contact with the heating drum 72.

Here, the heating drum 72 serving as the contact heater is also serving as a suction drum that performs air suction. However, the heating drum 72 may not perform air suction.

A dryer 104 according a tenth embodiment of the present disclosure is described in detail below with reference to FIG. 18.

Figure 18:
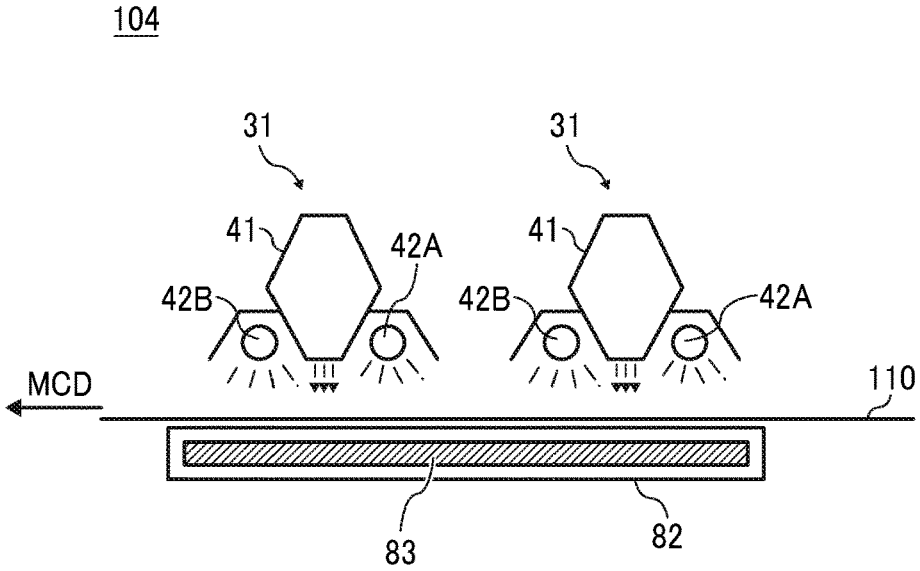
FIG. 18 is a schematic front view of the dryer according to a tenth embodiment of the present disclosure.

FIG. 18 is an enlarged cross sectional view of the dryer 104.

The dryer 104 according to the tenth embodiment includes a platen 82 serving as a contact heater. The platen 82 guides the continuous sheet 110 (drying object) during transportation of the continuous sheet 110.

The platen 82 includes a platen heater 83 inside the platen 82 and heats the continuous sheet 110 conveyed on the platen 82.

A treatment liquid applicator 600 according an eleventh embodiment of the present disclosure is described in detail below with reference to FIG. 19.

Figure 19:
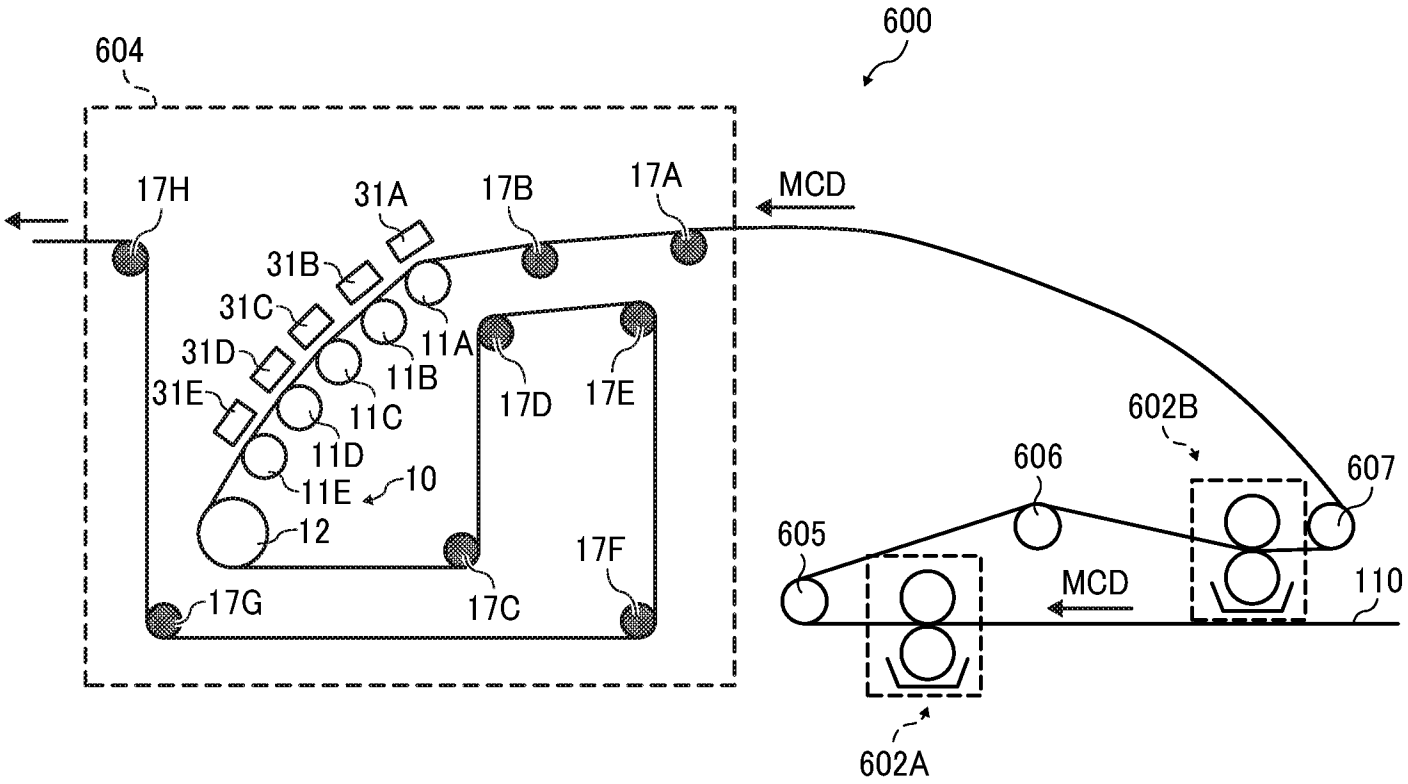
FIG. 19 is a schematic front view of a treatment liquid applicator according to an eleventh embodiment of the present disclosure.

FIG. 19 is a schematic front view of the treatment liquid applicator 600.

The treatment liquid applicator 600 of the present embodiment includes an applier 602 (602A and 602B) for applying a treatment liquid to continuous sheet 110 and a dryer 604 for drying the continuous sheet 110 coated with the treatment liquid.

Further, the treatment liquid applicator 600 includes conveyance rollers 605 through 607, for example, for guiding the continuous sheet 110.

Figure 6:
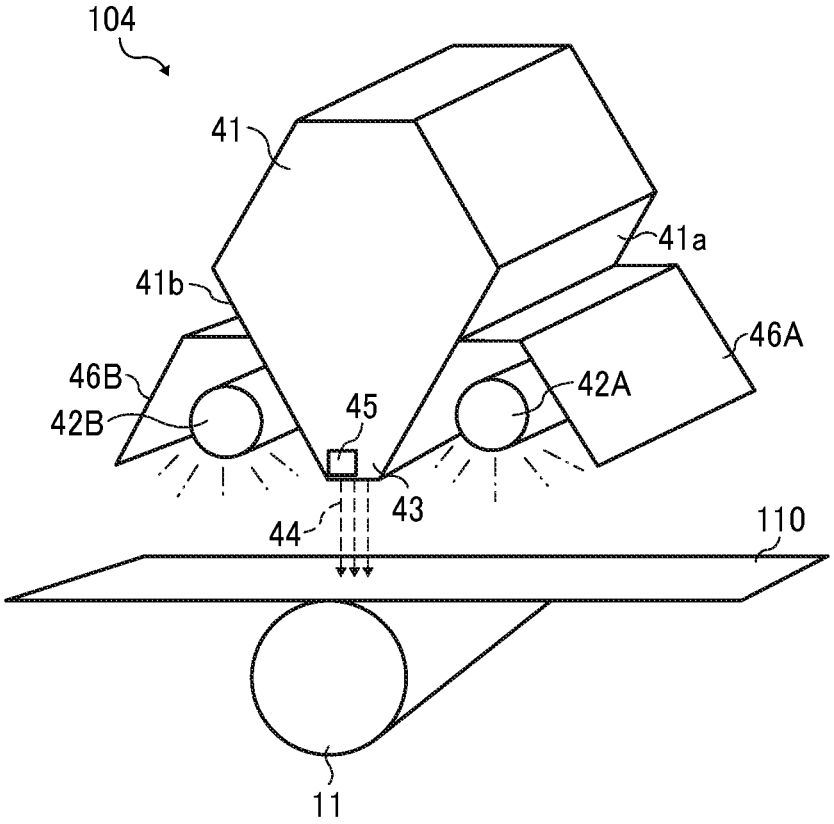
FIG. 6 is a perspective view of the non-contact heater.

A configuration of the dryer 604 in the present embodiment is similar to a configuration of the dryer 104 in the first embodiment illustrated in FIGS. 5 and 6. However, the configuration of the dryer 104 of other embodiments illustrated in FIGS. 11 through 18 may be applied for the configuration of the dryer 604 of the present embodiment.

As the treatment liquid, for example, there is a modifying material to modify a surface of the continuous sheet 110 by being applied to the surface of the continuous sheet 110.

As a composition of the treatment liquid, for example, a solution to which cellulose that promotes penetration of moisture and a base material such as talc fine powder are added to surfactant may be used. The cellulose includes, for example, hydroxypropyl cellulose. The surfactant includes, for example, any one of anionic, cationic, and nonionic surfactants, or a mixture of two or more of the foregoing surfactants.

The treatment liquid may also contain fine particles.

In each of the above-described embodiments, examples in which the drying object is continuous sheet 110 are described. However, the drying object of the present embodiment is not limited to the continuous sheet 110, as long as the drying object is a member to be dried by the dryers 104 and 604 according to the present disclosure.

For example, the drying object may be a printed object, such as a sheet for an electronic circuit board, wallpaper, and prepreg, for example, in addition to a recoding medium (printed object) such as a continuous body, such as a continuous sheet, a roll sheet, and a web, and an elongated sheet material.

The printer 1000 may record an image such as characters or figures on the drying object with a liquid such as ink. The printer 1000 may also record a meaningless image such as a pattern by applying liquid such as ink onto the dying object for a decoration purpose.

Herein, the liquid to be applied to the drying object is not particularly limited, but it is preferable that the liquid has a viscosity of less than or equal to 30 mPa·s under a normal temperature and a normal pressure or by being heated or cooled.

Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and/or edible materials (e.g., natural colorants). Such liquids can be used as inkjet inks, surface treatment liquids, liquids for forming compositional elements of electric or luminous elements or electronic circuit resist patterns, and 3D modeling material liquids.

When a liquid discharge head is used as the liquid applicator, examples of an energy generation source discharging a liquid include an energy generation source using a piezoelectric actuator (a lamination-type piezoelectric element and a thin-film piezoelectric element), a thermal actuator using an electrothermal transducer element such as a heating resistor, a static actuator including a diaphragm plate and opposed electrodes, and the like.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A dryer for drying a drying object comprising:

a hot air generator to generate hot air to be blown onto the drying object;

a contact heater to contact and heat the drying object; and a controller to control a heating temperature of the contact heater and a temperature of the hot air, wherein the controller controls the heating temperature of the contact heater to be above a first predetermined temperature from a start of generation of the hot air by the hot air generator until the temperature of the hot air reaches a second predetermined temperature.

2. The dryer according to claim 1, wherein the hot air generator includes:

a chamber;

a blower to send air to the chamber; and a radiation heater to heat the air in the chamber.

3. The dryer according to claim 2, wherein the chamber includes a nozzle that ejects the air in the chamber from the nozzle;

the radiation heater is disposed outside the chamber and adjacent to the chamber; and the radiation heater heats the air in the chamber with a radiant heat from the radiation heater.

4. The dryer according to claim 3, further comprising a plurality of chambers disposed adjacent with each other, wherein the radiation heater is disposed between adjacent two of the plurality of chambers, and the radiation heater heats the air in the adjacent two of the plurality of chambers with the radiant heat from the radiation heater.

5. The dryer according to claim 2, wherein the radiation heater is disposed to face the drying object to apply a radiant heat to the drying object.

6. The dryer according to claim 2, wherein the hot air generator includes:

a hot air generating device including a blower and a heater to generate hot air;

the chamber including a nozzle to blown out the hot air generated by the hot air generating device from the nozzle; and the radiation heater to heat the air in the chamber, wherein the radiation heater is disposed outside the chamber and adjacent to the chamber, and the radiation heater heats the hot air in the chamber with a radiant heat from the radiation heater.

7. The dryer according to claim 2, wherein the radiation heater is an infrared heater.

8. The dryer according to claim 1, wherein the hot air generator includes:

a hot air generating device including a blower and a heater to generate hot air; and a part including a nozzle to blown out the hot air generated by the hot air generating device from the nozzle.

9. The dryer according to claim 1, wherein the contact heater is a heating roller.

10. A printer comprising:

a liquid applicator to apply liquid to the drying object; and the dryer according to claim 1.

11. A treatment liquid applicator comprising:

an applier to apply treatment liquid to the drying object; and the dryer according to claim 1.

* * * * *